United States Patent [19]

Pascal et al.

[11] Patent Number: 4,679,815

[45] Date of Patent: Jul. 14, 1987

[54] SAFETY SKI BINDING

[75] Inventors: Roger Pascal, Annecy-Le-Vieux; Jean P. Dimier, Rumilly, both of France

[73] Assignee: Salomon S.A., Annecy, France

[21] Appl. No.: 621,734

[22] Filed: Jun. 18, 1984

[30] Foreign Application Priority Data

Jun. 20, 1983 [FR] France ..... 83 10819

[51] Int. Cl.[4] ..... A63C 9/081

[52] U.S. Cl. ..... 280/618; 280/620; 280/628; 280/633

[58] Field of Search ..... 280/620, 618

[56] References Cited

U.S. PATENT DOCUMENTS

| | | | |
|---|---|---|---|
| 3,145,027 | 8/1964 | Berchtold | 280/620 |
| 3,647,235 | 3/1972 | Beyl | 280/618 |
| 4,230,338 | 10/1980 | Weigl | 280/618 |

FOREIGN PATENT DOCUMENTS

| | | | |
|---|---|---|---|
| 0025747 | 3/1981 | European Pat. Off. . | |
| 1960002 | 1/1980 | Fed. Rep. of Germany | 280/618 |
| 1179140 | 10/1984 | Fed. Rep. of Germany | 280/618 |
| 2458299 | 1/1961 | France . | |
| 83748 | 8/1964 | France . | |
| 2198762 | 4/1974 | France . | |
| 2263796 | 10/1975 | France . | |
| 2279433 | 2/1976 | France . | |
| 2258876 | 8/1976 | France . | |
| 2305208 | 10/1976 | France . | |
| 2314742 | 1/1977 | France . | |
| 2334382 | 7/1977 | France . | |
| 2338060 | 8/1977 | France . | |
| 2233081 | 10/1978 | France . | |
| 2411019 | 7/1979 | France . | |
| 2420359 | 10/1979 | France . | |
| 2433958 | 3/1980 | France | 280/618 |
| 2497109 | 7/1982 | France | 280/618 |
| 2502019 | 9/1982 | France . | |
| 2517214 | 6/1983 | France . | |
| 2521017 | 8/1983 | France | 280/618 |
| WO82/02495 | 8/1982 | PCT Int'l Appl. | 280/618 |

*Primary Examiner*—David M. Mitchell

*Attorney, Agent, or Firm*—Sandler & Greenblum

[57] ABSTRACT

A ski binding for releasably securing a boot to a ski. The boot includes a pivotable plate adapted to be pivotably secured to the ski whereby the plate is pivotable on the ski around an axis substantially perpendicular relative to the upper surface of the ski. The plate pivots to an unaligned position relative to the binding during release of the boot. First and second hold down are provided for securing the front and rear of the boot onto the ski. The second hold down is mounted on the plate. The first hold down is elastically pivotable to allow for release of the boot with pivoting of the first hold down, and is operatively associated with the plate whereby realignment of the first hold down relative to the binding is accompanied by automatic realignment of the plate.

27 Claims, 12 Drawing Figures

SAFETY SKI BINDING

TECHNICAL FIELD

1. Field of the Invention

The present invention relates to a safety binding adapted to releasably secure a boot to a ski. More particularly, the invention relates to a binding known as a "pivotable plate binding" on which the ski boot is secured.

2. Description of Pertinent Materials

Numerous apparatus of the traditional type are known in which the boot is maintained on a ski by a front abutment and by a heel abutment. These apparatus are very popular but, nevertheless, suffer from a certain number of drawbacks. Such drawbacks, for example, include lack of reliability and low resistance to lateral shocks, as well as alteration of the release thresholds as a function of the quality or the state of the soles of the boot.

To overcome these disadvantages, manufacturers have sought to develop other embodiments and have perfected "pivotable plate" apparatus in which the boot is maintained on the ski by means of a plate positioned to rotate around a pivot attached to the ski. According to certain embodiments, the plate does not leave the ski, and it is the boot alone which is freed, while other embodiments, the boot remains associated with the plate and the entire assembly is released.

By way of example, reference is made to French Pat. No. 2,279,433, in which the plate is pivotably connected to the ski. The plate comprises a non-releasable retention element for the front end of the boot at its front end, and at its rear end, a releasable retention element for the heel. This type of embodiment is particularly complex, and the release of the boot during torsion occurs only at the rear of the boot, which is a serious disadvantage. Furthermore, in this system once the ratio between the vertical and lateral release forces has initially been set by the manufacturer, it may not necessarily be valid for all skiers.

Another known apparatus is described in French Pat. No. 2,198,762 and comprises a pivotable plate comprising a fixed retention element to maintain the front of the boot and an unlatchable element to retain the heel of the boot. The plate is freed and leaves the ski together with the boot, and the skier must then reposition the plate to the latched position on the ski, and also reset the pivot. This operation is sometimes very difficult, particularly in powder snow or on a steep slope.

Another known plate described in French Pat. No. 2,305,208, comprises a particularly complex mechanism, which is thus expensive, relatively less liable, and sensitive to environmental conditions (mud, ice, etc.).

DESCRIPTION OF PREFERRED EMBODIMENTS

It is, therefore, an object of the invention to overcome the above drawbacks and disadvantages, and to provide a ski binding for releasably securing a boot to a ski which includes a pivotable plate adapted to be pivotably secured to the ski whereby the plate is pivotable on the ski around an axis substantially perpendicular relative to the upper surface of the ski. The plate pivots to an unaligned position relative to the binding during release of the boot. First and second means are provided for securing the front and rear of the boot onto the ski. The first means is elastically pivotable to allow for release of the boot with pivoting of the first means, and is operatively associated with the plate whereby realignment of the first means relative to the binding is accompanied by automatic realignment of the plate. According to a most preferred embodiment the realignment of the first means automatically causes the plate to realign. The second means is preferably mounted on the plate.

In one embodiment illustrated in the drawings, the first and second means each comprises a jaw adapted to secure the toe and heel of the boot respectively.

The plate itself pivots around an axis provided by a pivot member adapted to be mounted on the ski. The pivot member is adapted to prevent lifting of the plate off of the ski. The pivot member may comprise an abutment which prevents the plate from being raised off of the ski.

An element may additionally be provided which is adapted to be secured to the ski and which has an upper edge adapted to project over an edge of the plate to prevent the plate from lifting off of the ski and to provide an empty space to allow for the pivoting of the plate relative to the ski.

According to one embodiment, the first means is operatively associated with the plate by means of linkage means for linking the first means with the plate, and transmitting rotational movement of the first means to the plate. The first means may be a jaw adapted to hold the toe of the boot with the jaw being biased to return to a centered position relative to the binding. The linkage means links the lower portion of the jaw of the first means to the front end of the plate whereby return of the jaw to the centered position serves to automatically center the plate relative to the binding.

The linkage means may comprise a pin and slot with the pin being positioned within the slot so as to slide therein and allow for the linked pivotable movement of the plate relative to the jaw.

The jaw may comprise the pin with the slot being positioned on the front end of the plate. In this case, the pin depends downwardly from the jaw and is oriented towards the ski. Alternatively, the plate may comprise an upwardly extending pin at its front end, with the slot being positioned on the jaw.

According to yet another embodiment the plate comprises a pivot member at its front end, and the slot is positioned on a linkage rod secured to the jaw. The linkage rod may be secured to the jaw by a clip, with the linkage rod being pivotable relative to the clip around an axis transverse to the axis around which the plate pivots relative to the ski. The clip is pivotable relative to the jaw of the first means around an axis transverse to the axis around which the plate pivots relative to the ski.

A jaw forming the second means may be mounted on the plate by means of two lateral arms, with each of the lateral arms being pivotably mounted on the plate. The jaw is pivotably mounted on each of the arms whereby the arms and and jaw are both pivotably mounted around axes perpendicular to an axis normal to the upper surface of the ski.

Alternatively, the second means may comprise a jaw pivotably mounted on a body secured to the rear portion of the plate.

According to yet another alternative the plate may comprise an arctuate cutout therein with the first means being a jaw mounted pivotably on a support extending through the cutout whereby the plate is free to pivot on the ski over a limited extent defined by the ends of the cutout. The plate comprises a slot, and the jaw comprises a pin downwardly extending therefrom into the slot. The slot extends along the longitudinal axis of the plate, whereby the pin moves within the slot during pivoting of the plate. The dimensions of the cutout and the slot are selected to define the extent of rotation of the plate.

BRIEF DESCRIPTION OF THE DRAWINGS

FIG. 1 is a side, partial cross-sectional view of the invention;

FIG. 2 is a top plan view, in partial cross-section, of the binding in the centered position;

FIG. 3 is a perspective view illustrating a torsional release position;

FIG. 4 is a top plan view illustrating the binding in the off-center position;

FIGS. 5 and 5*a* illustrate a single embodiment of the invention wherein:

FIG. 5 is a partial, side view;

FIG. 5*a* is a partial top view;

FIGS. 6 and 6*a* illustrate an alternative linkage means wherein:

FIG. 6 is a partial side view in longitudinal partial cross-section;

FIG. 6*a* is a partial top view with a partial cross-sectional view corresponding to that of FIG. 6;

DESCRIPTION OF PREFERRED EMBODIMENTS

It is an object of the present invention to overcome the disadvantges related above in connection with the described "pivotable plate" systems. To achieve this, the safety binding according to the invention comprises a plate which is pivotable with respect to a ski and which pivots around a substantially vertical axis. The binding has first and second retention means adapted to retain the front and rear portions of the boot. The apparatus is characterized by the fact that the first retention means is adapted to be positioned on the ski and comprises a jaw which is movable at least laterally against the action of an elastic system, and the second retention means are attached on the plate, generally at its rear portion and comprises a jaw adapted to retain, in a releasable manner, the rear of the boot. The jaw is mobile at least vertically against the action of an elastic system. The first retention means is connected in a non-releasable manner to the front end of the plate by linkage and transmission means such that after release, the return to the centered position of the jaw of the first retention means in turn assures the return to the centered position of the plate comprising the second retention means.

Figure 1:
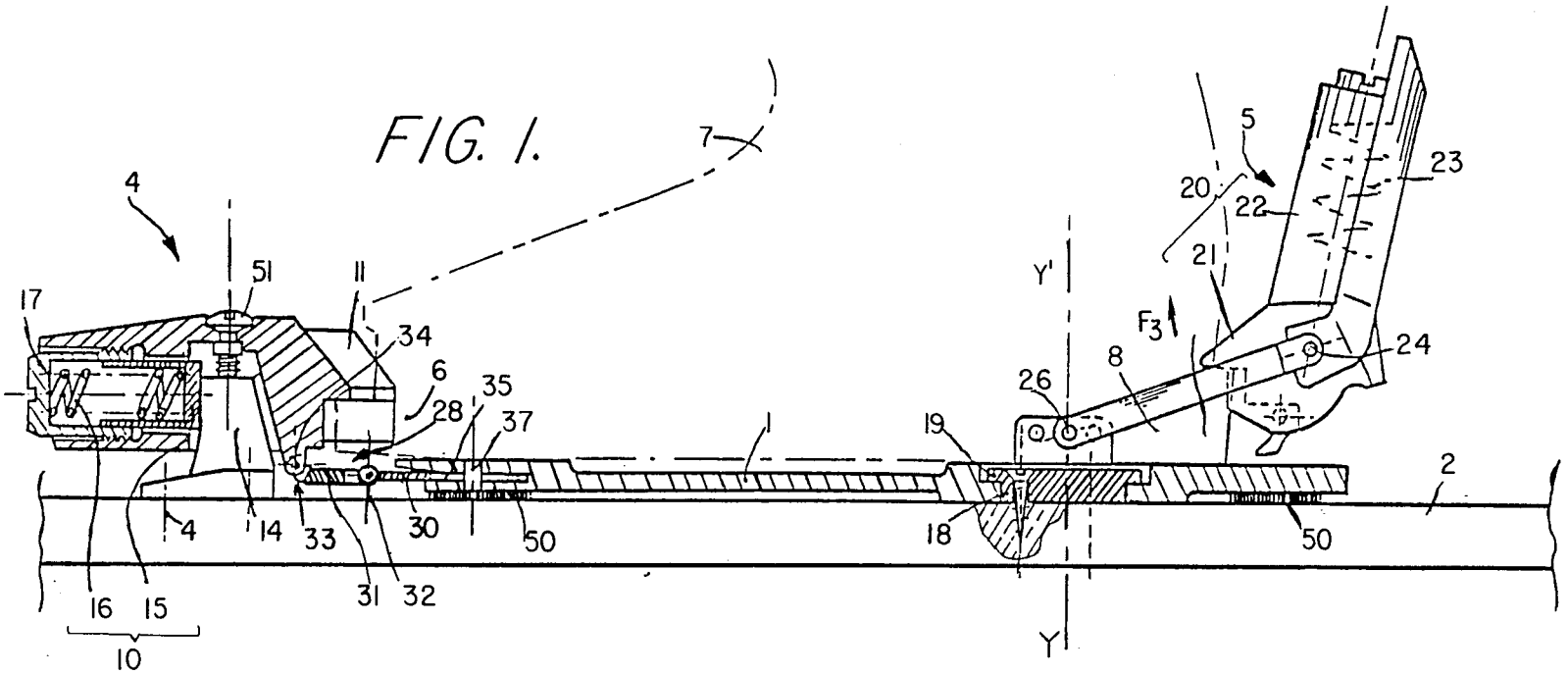
FIGS. 1–4 illustrate a first embodiment of the invention.
Figure 2:
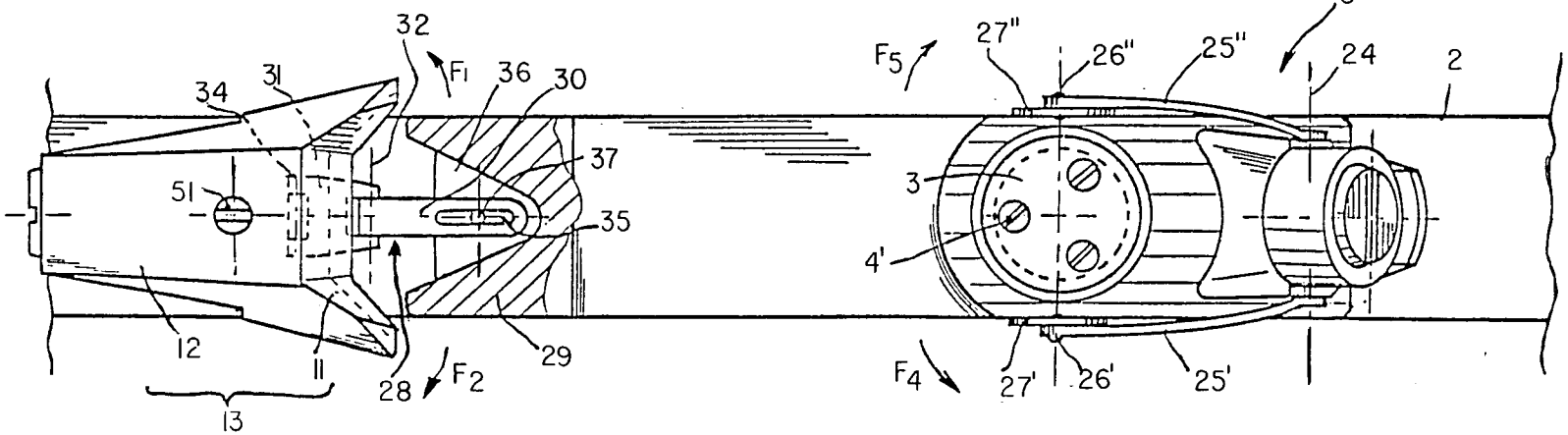

The binding according to the first embodiment shown in FIG. 1 comprises a plate 1 pivotably mounted on ski 2 around a vertical pivot axis YY′ formed by a pivot member 3 (FIG. 2) attached to the ski by screws 4′, and retention means 4 and 5. First retention means 4 is adapted to retain the front 6 of boot 7 while second retention means 5 is adapted to retain the rear portion 8 thereof. According to one aspect of the invention, first retention means 4 is connected directly to the ski in front of plate 1 and a certain distance therefrom, while second retention means 5 is positioned on the rear portion of plate 1.

First retention means 4 comprises a jaw 11, movable at least laterally along $F_1$ and $F_2$ against the action of an elastic energization system 10. Such a retention means is well-known and may, for example, be of the type illustrated in French Pat. No. 81.22577, the disclosure of which is hereby incorporated by reference thereto. Further detailed description of the retention means is not required; however, it should be noted that the system comprises a jaw 11 extending into body 12 to form a pivotable assembly 13 which pivots with respect to a support element 14 attached to the ski by screws 4. The pivoting of assembly 13 occurs against the action of elastic system 10, comprising a movable element or piston 15 biased by a spring 16 supported against an adjustment cap 17. Furthermore, the front abutment can comprise a screw 51 to allow for adjustment of the height of the jaw.

Plate 1 is pivotably mounted around a pivot member 3 which comprises a lower narrowed smoothed pivot portion 18 and a generally circular abutment shoulder 19 assuring the vertical retention of the plate.

As was previously noted, the second retention means 5 can, for example, be of the type described in French Pat. No. 2,258,876. This system comprises a journalled assembly 20 constituted by a jaw 21 extending into a body 22 which extends upwardly and contains an elastic system 23. Journalled assembly 20 is mounted to pivot around an axis pin 24 carried at the end of two lateral arms 25′ and 25″, which are themselves journalled around transverse axis pins 26′ and 26″, which are aligned and carried by vertically bent lateral portions 27′ and 27″ integral with plate 1. Assembly 20 is movable around axis 24 along $F_3$ to vertically free the boot, and is mounted on the rear portion of the plate so that it is rotational together with the plate along $F_4$ and $F_5$ around vertical axis YY′, as may ben seen in FIGS. 3 and 4. According to the invention, the apparatus comprises linkage means 28 to associate the first retention means 4 to the front end 29 of plate 1. Linkage means 28 comprises linkage rod 30 and clip 31 journalled relative to one another around a transverse axis 32. The front portion of the clip is journalled with respect to the lower portion of jaw 9 around a transverse axis 34. The rear portion of rod 30 comprises a longitudinal slot 35 extending to the interior of an opening 36, provided within the front end 29 of plate 1. Opening 36 expands and opens towards the front to allow for the pivoting of rod 30 therein. In effect, a pin 37 integral with the plate moves along slot 35 to allow for a rotational and translational displacement of linkage rod 30. Journalled linkage rod and clip system 30 and 31 make it possible to modify the vertical position of jaw 11, for example, as may occur as a result of a height adjustment performed by manipulation of screw 51.

Figure 3:
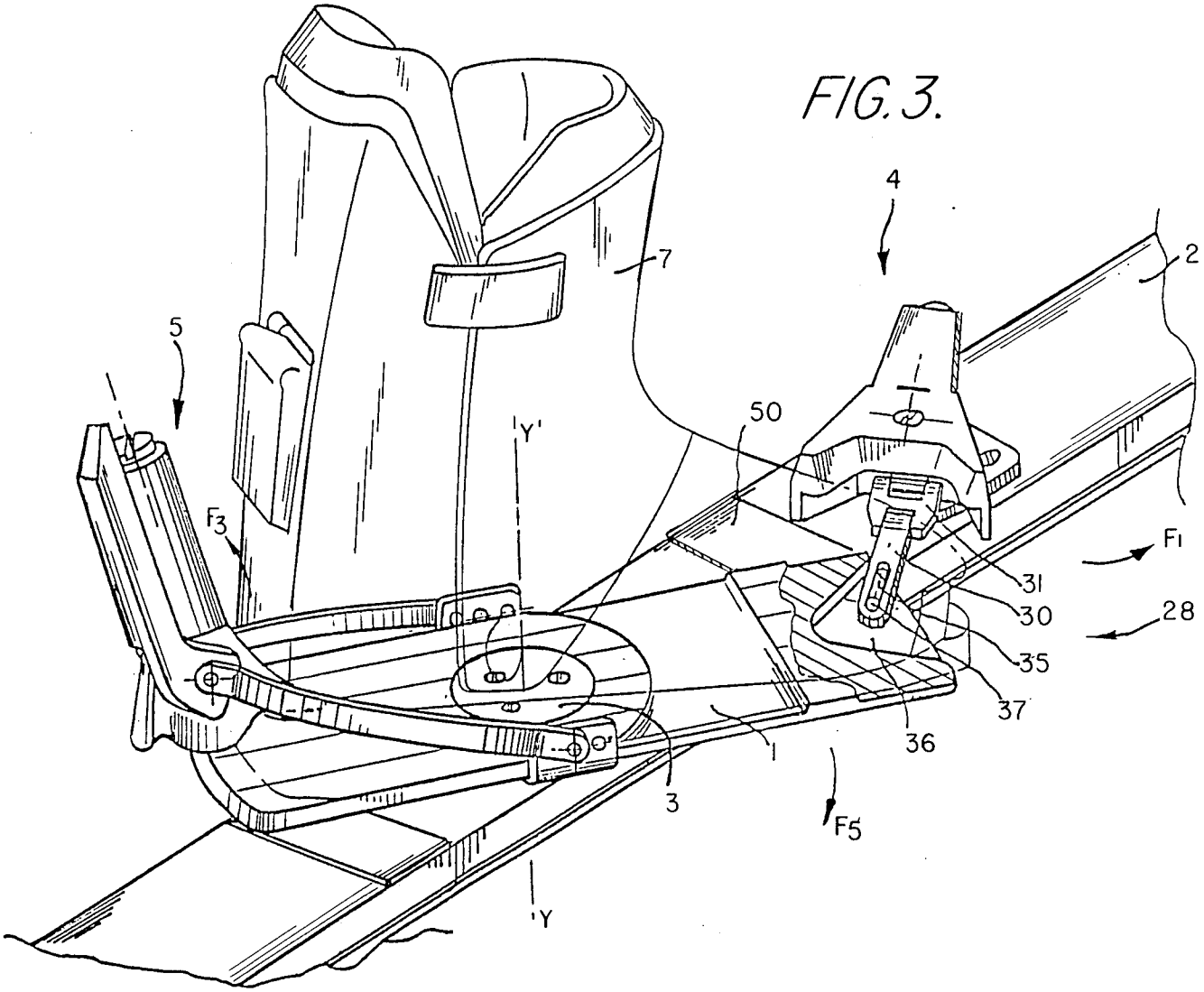

FIG. 3 shows one phase of a torsional release. It is noted that plate 1, as well as rear retention means 5, pivot together around axis YY′, while the front retention means pivots laterally along $F_1$. Of course, vertical release of boot 7 occurs by pivoting of assembly 20 around axis 24 along $F_3$.

Figure 4:
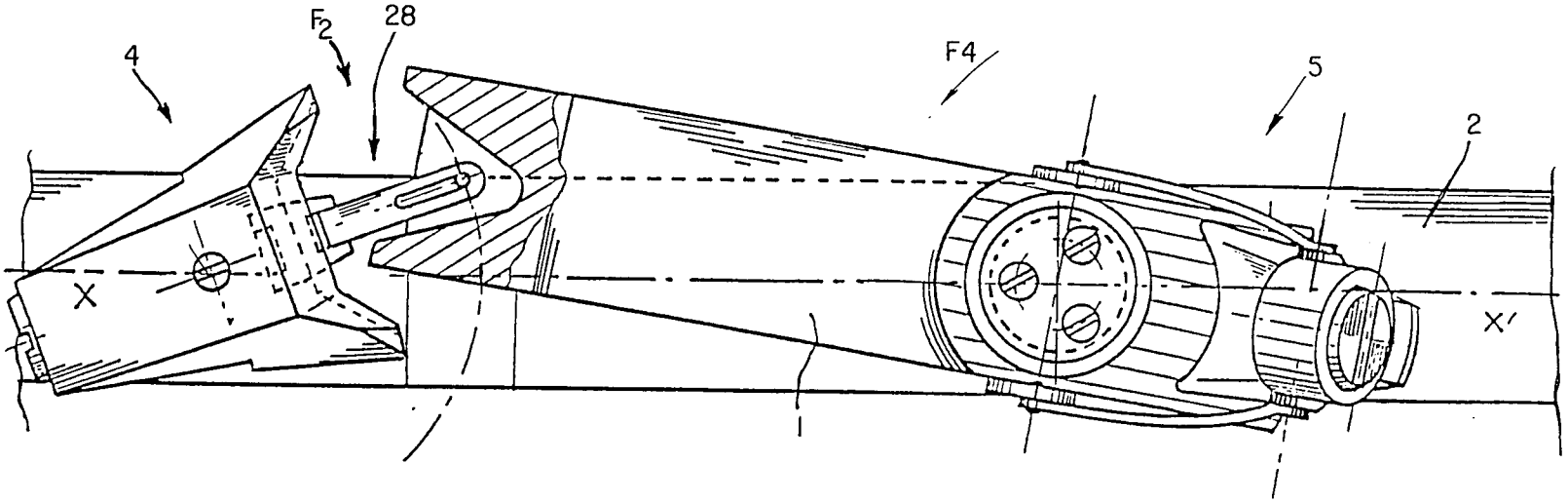

FIG. 4 illustrates the binding during return to a centered position of the assembly after release, with jaw 11 being biased by elastic system 10 to its centered position so as to move plate 1 together with it by means of linkage means 28. Thus, after lateral release, the entire assembly is brought back to a centered position along longitudinal axis XX'.

Front retention means 4 can be of any type and may, for example, be of the type described in French Pat. Nos. 2,314,742; 2,334,382; 2,420,359; 2,458,299; French Addition Pat. No. 83,748; or European Application No. 0025747.

Rear retention means 5 can be of any type and may, for example, be of the type described in French Pat. No. 2,502,019 and French Pat. No. 2,263,796.

Figure 5:
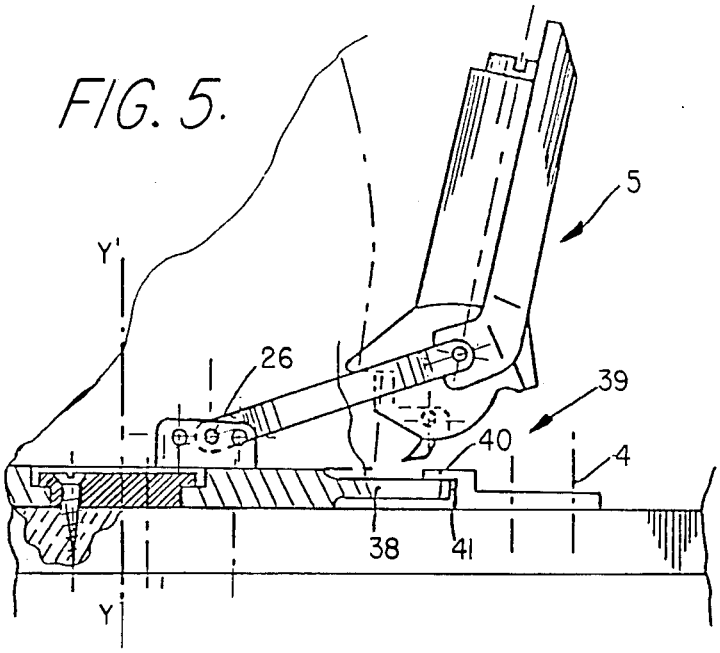
Figure 5A:
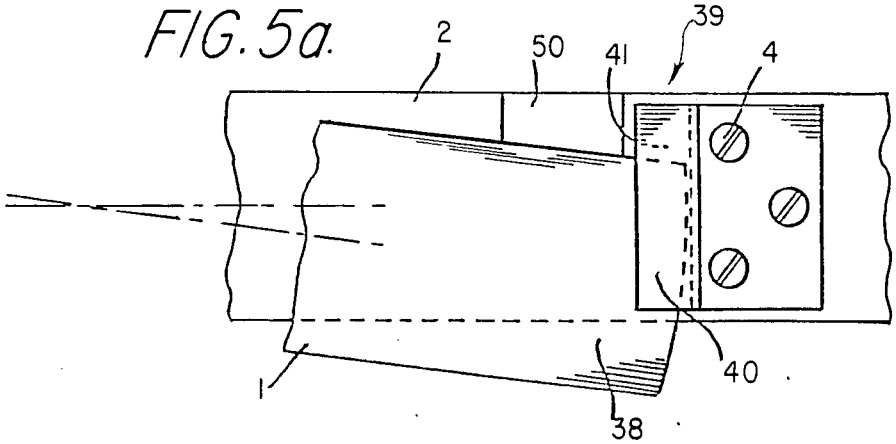

In the embodiment described in FIGS. 1–4, it will be seen that vertical axis YY' is located along the intersection of a line connecting axes 26' and 26''. However, it is possible, for example, to use a different arrangement, particularly as is shown in FIG. 5 in which pivot axis YY' is in front of the line connecting axes 26' and 26''. Under these conditions, rear portion 38 of plate 1 is held back against lifting by means of element 39, which is attached to the ski. This element comprises an upper edge 40, on top of open space 41 which constitutes a lateral opening in which the rear of the plate is engaged in a manner so as to allow for pivoting of the plate without lifting (FIG. 5*a*).

Figure 6:
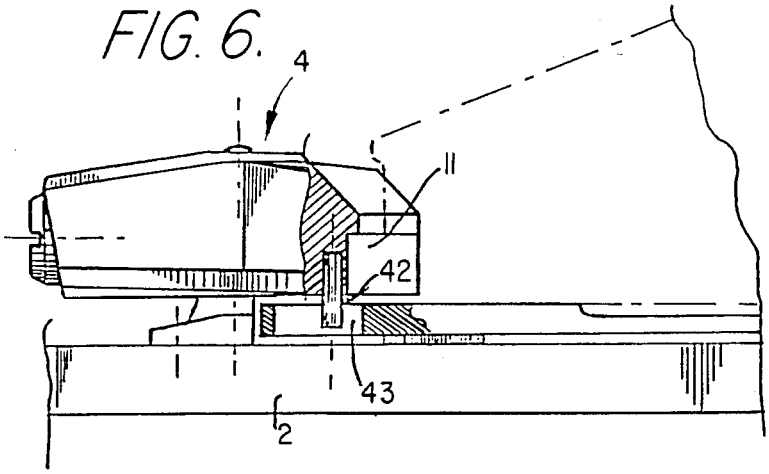
Figure 6A:
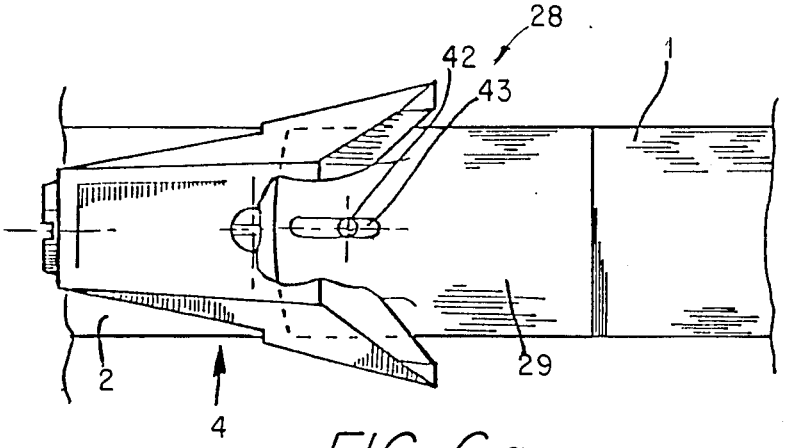

FIGS. 6 and 6*a* illustrate an alternative embodiment of linkage means 28 in which the lower portion of jaw 11 comprises a downwardly extending projection 42 positioned to extend within slot 43 provided at front end 29 of the plate.

Figure 7:
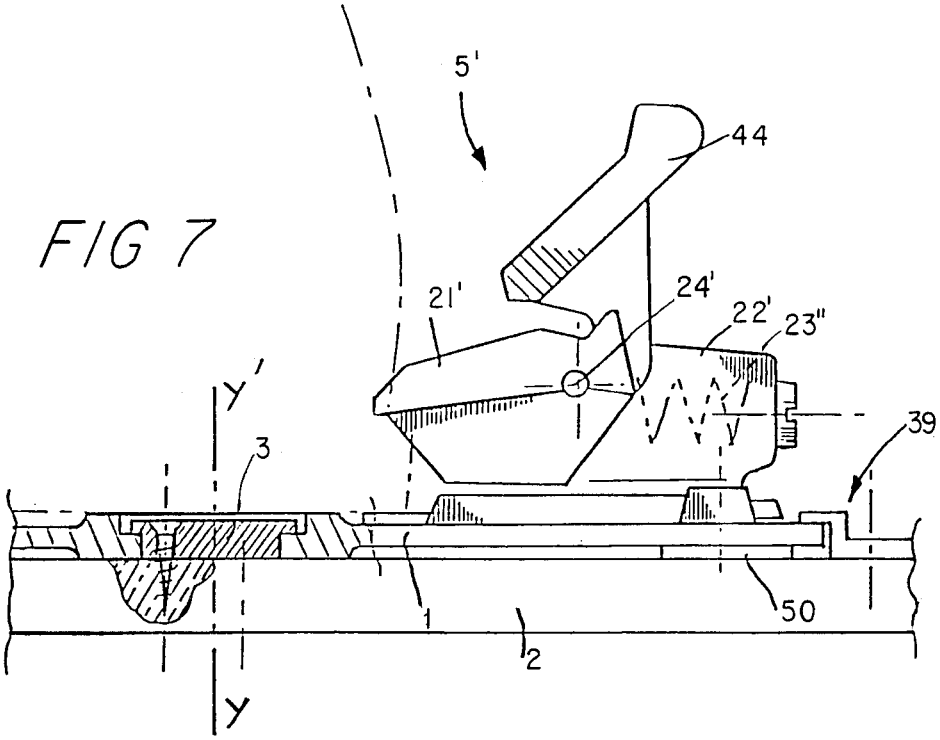
FIG. 7 is a partial side view illustrating one alternative embodiment of the rear retention means.

Rear retention means 5, previously described, are of the boot loop or lateral arm type 25' and 25'', but they could otherwise be of any type and particularly of the heel or "talonniere" type 5', as is shown in FIG. 7. Such a rear retention means is described, for example, in French Pat. No. 2,338,060, and may comprise a jaw 21' pivoting around an axis 24' with respect to a body 22' affixed to the rear portion of plate 1. Jaw 21' is biased in a retention position by an elastic system 23'' positioned in body 22', while lever 44 makes it possible to voluntarily remove the boot. The rear portion of the plate is prevented from lifting off of the plate by an element 39 identical to that described with reference to FIG. 5. Preferably, plate 1 is, at its front end 29, supported on an anti-friction plate 50 (FIGS. 1, 3, 4). This plate is attached to the ski, for example, by gluing, and is made of a material having a low coefficient of friction. By virtue of anti-friction plate 50, which can be made of polytetrafluroethylene, the friction is controlled and remains constant, whatever the type of boot utilized. Boot 7 moves together with pivotable plate 1 and can thus have a sole made of rubber, which facilitates walking with the boots when they are not attached to the skis.

Figure 8:
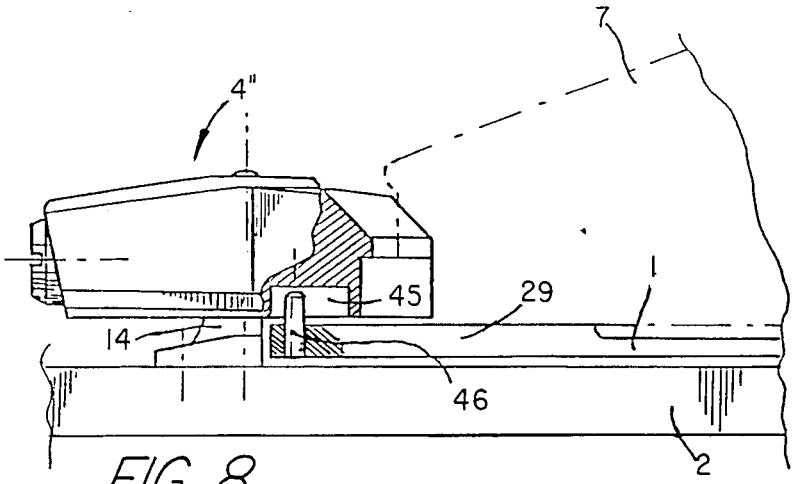
FIG. 8 is a view similar to FIG. 6, illustrating one embodiment.

FIG. 8 illustrates an alternative linkage in which the front end 29 of the plate comprises a projection pin 46 engaging a slot 45 of front retention means 4''.

Figure 9:
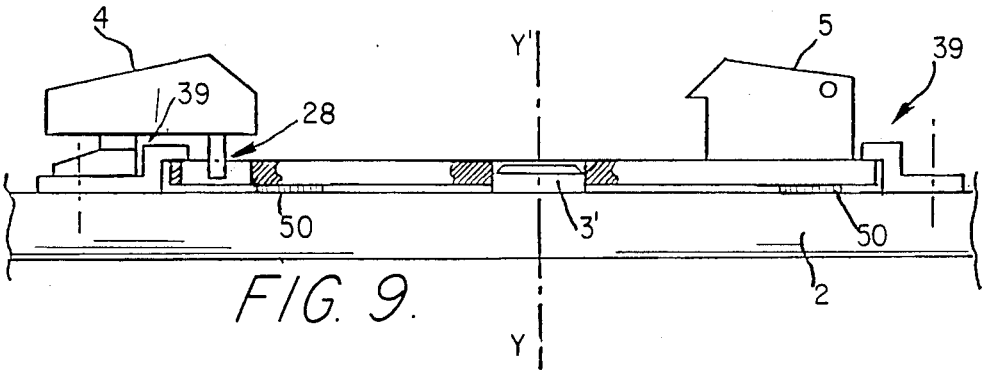
FIG. 9 is a side schematic view, illustrating one alternative embodiment in which lifting of the plate is prevented by edge retention means.

FIG. 9 illustrates yet another alternative embodiment, in which pivot member 3' does not provide relative retention against upward movement of the plate. This retention is ensured instead by two elements 39 attached at each end.

Figure 10:
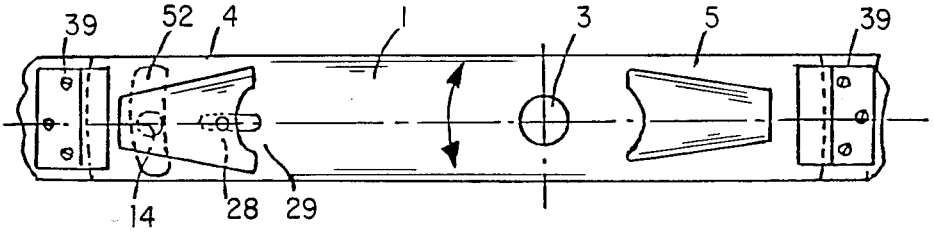
FIG. 10 is a top schematic view of yet another embodiment of the invention.

FIG. 10 illustrates an alternative embodiment in which front end 29 of plate 1 extends frontwardly beyond front retention means 4. In this case, the plate comprises an arctuate slot 52 which allows for the passage of a support element attached to the ski which supports retention means 4 while allowing for the pivoting of plate 1. The plate again comprises a slot positioned to cooperate with a pin extending downwardly from the retention means. The slots are configured and positioned in a manner so as to define the extent of rotation of the plate.

Of course, the invention is not limited to the particular embodiments described and extends to all equivalent means, materials, and embodiments falling within the scope of the claims.

What is claimed is:

1. A ski binding for releasably securing a boot to a ski, said binding comprising:

(a) a pivotable plate adapted to be pivotably secured to said ski whereby said plate is pivotable on said ski around an axis substantially perpendicular to the upper surface of said ski, said plate pivoting to an unaligned position relative to said binding during release of said boot;

(b) first and second means for securing the front and rear of said boot onto said ski, said first means being elastically pivotable to allow for release of said boot with pivoting of said first means, wherein said second means is mounted on said plate;

(c) means for linking said first means with said plate whereby realignment of said first means relative to said binding is accompanied by automatic realignment of said plate, wherein said linkage means further comprises a linkage rod secured to said first means by a clip, said linkage rod being pivotable relative to said clip around an axis transverse to the axis around which said plate pivots relative to said ski, and wherein said clip is pivotable relative to said first means around an axis transverse to the axis around which said plate pivots relative to said ski to allow for height adjustment of said first means relative to said plate.

2. The ski binding as defined by claim 1 wherein realignment of said first means automatically causes said plate to realign.

3. The ski binding as defined by claim 2 wherein said first and second means each comprises a jaw adapted to secure the toe and heel of said boot respectively.

4. The ski binding as defined by claim 3 wherein said second means is pivotable against an elastic resistance.

5. The ski binding as defined by claim 1 wherein said plate pivots around an axis provided by a pivot member adapted to be mounted on said ski.

6. The ski binding as defined by claim 5 wherein said pivot member is adapted to prevent lifting of said plate off of said ski.

7. The ski binding as defined by claim 6 wherein said pivot member comprises an abutment which prevents said plate being lifted off of said ski.

8. The ski binding as defined by claim 1 further comprising an element adapted to be secured to said ski, said element having an upper edge adapted to project over an edge of said plate to prevent said plate from lifting off of said ski and to provide an empty space to allow for the pivoting of said plate relative to said ski.

9. The ski binding as defined by claim 1 wherein said first means is a jaw adapted to hold the toe of said boot and wherein said jaw is biased to a centered position relative to said binding, and further wherein said linkage means links the lower portion of said jaw of said first means to the front end of said plate whereby return of said jaw to said centered position serves to automatically center said plate relative to said binding.

10. The ski binding as defined by claim 9 wherein said linkage means comprises a pin and slot, said pin being positioned within said slot so as to slide therein and allow for the linked pivotable movement of said plate relative to said jaw.

11. The ski binding as defined by claim 1 wherein said linkage means further comprises a pin and slot, said pin being positioned within said slot so as to slide therein and allow for the linked pivotable movement of said plate relative to said jaw, wherein said slot is positioned on said linkage rod, with said pin being positioned on said plate.

12. The ski binding as defined by claim 1 wherein said second means is a jaw adapted to secure the heel of said boot to said ski, and wherein said jaw is pivotably mounted on a support element adapted to be secured to said ski.

13. The ski binding as defined by claim 1 wherein said second means comprises a jaw mounted on said plate by means of two lateral arms, each of said lateral arms being pivotably mounted on said plate, and wherein said jaw is pivotably mounted on each of said arms whereby said arms and jaw are both pivotably mounted around axes perpendicular to an axis normal to the upper surface of said ski.

14. The ski binding as defined by claim 1 wherein said second means comprises a jaw pivotably mounted on a body secured to the rear portion of said plate.

15. The ski binding as defined by claim 1 wherein said first means is secured to the ski in front of the front end of said plate.

16. The ski binding as defined by claim 1 wherein said first means comprises:

(i) means for retaining the front of said boot, wherein said retaining means is spaced a predetermined distance in front of said plate; and (ii) a support spaced a predetermined distance in front of said plate for supporting said retaining means and around which said retaining means elastically pivots.

17. The ski binding as defined by claim 16 wherein said first means further comprises:

(iii) means for elastically biasing said retaining means against pivoting on said support, wherein said biasing means is mounted on said support.

18. The ski binding as defined by claim 1 wherein said first means is spaced a predetermined distance in front of said plate.

19. The ski binding as defined by claim 1 wherein said first means is a jaw adapted to hold the toe of said boot, wherein said jaw is biased to a centered position relative to said binding, wherein said linkage means links the lower portion of said jaw of said first means to the front end of said plate whereby return of said jaw to said centered position serves to automatically center said plate relative to said binding.

20. A ski binding for releasably securing a boot to a ski, said binding comprising:

(a) a pivotable plate adapted to be pivotably secured to said ski whereby said plate is pivotable on said ski around an axis substantially perpendicular to the upper surface of said ski, said plate pivoting to an unaligned position relative to said binding during release of said boot;

(b) first and second means for securing the front and rear of said boot onto said ski, said first means being elastically pivotable to allow for release of said boot with pivoting of said first means, wherein said second means is mounted on said plate;

(c) said first means being operatively associated with said plate whereby realignment of said first means relative to said binding is accompanied by automatic realignment of said plate, wherein said plate comprises an arcuate cutout therein and wherein said first means is a jaw pivotably mounted on a support extending through said cutout whereby said plate is free to pivot on said ski over a limited extent defined by the ends of said cutout.

21. The ski binding as defined by claim 20 wherein said first means is operatively associated with said plate by means of linkage means for linking said first means with said plate, and transmitting the rotational movement of said first means to said plate.

22. The ski binding as defined by claim 15 wherein said plate further comprises a slot, and wherein said jaw comprises a pin downwardly extending therefrom into said slot, said slot extending along the longitudinal axis of said plate, whereby said pin moves within said slot during pivoting of said plate, and wherein the dimensions of said cutout and said slot are selected to define the extent of rotation of said plate.

23. The ski binding as defined by claim 15 wherein said plate and said first means together comprise means for automatically realigning said plate in response to release of said boot.

24. The ski binding as defined by claim 15 wherein said plate and said first means together comprise means for automatically realigning said plate in response to said first means pivoting out of alignment with respect to said plate.

25. The ski binding as defined by claim 15 further comprising means for biasing said first means into alignment with said plate wherein said biasing means automatically biases said first means into alignment with said plate after said first means pivots out of alignment with said plate.

26. The ski binding as defined by claim 25 wherein said pivotable plate and said first means together comprise means for automatically realigning said plate in response to said automatic realignment of said first means.

27. The ski binding as defined by claim 15 wherein said first means elastically pivots out of alignment with said plate as soon as said plate pivots to said unaligned position relative to said binding.

* * * * *